US005852901A

United States Patent [19]

Meyers

[11] Patent Number: 5,852,901

[45] **Date of Patent: *Dec. 29, 1998**

[54] STACKABLE RISER FOR ON-SITE WASTE AND DRAINAGE SYSTEMS

[75] Inventor: Theodore W. Meyers, Barrington, Ill.

[73] Assignee: Tuf-Tite, Inc., Wauconda, Ill.

[ * ] Notice: The term of this patent shall not extend beyond the expiration date of Pat. No. 5,617,679.

[21] Appl. No.: 769,950

[22] Filed: Dec. 19, 1996

Related U.S. Application Data

[63] Continuation-in-part of Ser. No. 365,706, Dec. 29, 1994, Pat. No. 5,617,679.

[51] Int. Cl.[6] ..... E02D 29/14

[52] U.S. Cl. ..... 52/20; 52/79.1; 52/136; 220/4.26; 405/136; 405/41

[58] Field of Search ..... 52/20, 79.1, 136, 52/169.6, 19, 134, 137, 161; 220/4.26, 4.03; 404/25, 26; 174/37, 39; 405/136, 41, 43, 80, 83, 137, 161

[56] References Cited

U.S. PATENT DOCUMENTS 5,617,679 4/1997 Meyers ..... 52/20

*Primary Examiner*—Carl D. Friedman
*Assistant Examiner*—W. Glenn Edwards
*Attorney, Agent, or Firm*—Tilton, Fallon, Lungmus & Chestnut

[57] ABSTRACT

A plastic stackable riser for providing a grade level access for underground components such as septic tanks, distribution boxes, and drop boxes, including a cylindrical side wall having a top free edge and a bottom edge. The top free edge defines a first end opening and the second bottom edge is connected to a generally inverted U-shaped connecting member which defines a channel shaped to receive the first free edge portion of an adjacent stackable riser. In use, a plurality of stackable risers are interlocked together so that the side walls all extend along common vertical axes to the underground component and provide a gas-tight, liquid-tight column above the underground component.

32 Claims, 9 Drawing Sheets

STACKABLE RISER FOR ON-SITE WASTE AND DRAINAGE SYSTEMS

This application is a Continuation-in-Part of application Ser. No. 08/365,706, filed Dec. 29, 1994, now U.S. Pat. No. 5,617,679.

BACKGROUND AND SUMMARY

Conventional drainage and septic systems typically include underground components which require periodic access for cleaning or servicing. Most notably, septic tanks are typically pumped out every few years or even, in some cases, annually or more frequently. Other components of septic systems such as distribution boxes also often require periodic servicing. In order to gain access to such underground components, workers commonly use metal rods or the like to first locate the component and then they must remove the dirt above the component which is labor-intensive. Often, workers must remove dirt over a fairly wide area to correctly locate the lid of the component, or an access opening in the lid. Obviously, the conventional methods of locating and gaining access to underground drainage and septic components are time consuming and expensive. In addition, there has been a general trend by states and municipalities to require grade level access to underground components, so as to prevent such components from becoming "lost" which frequently occurs.

Attempts have been made to remedy the above problems by providing grade level access and a passageway between grade level and the underground component. Such attempts have often been make-shift assemblies roughly put together in the field. In one known example, clay tile or cement chimney flues have been positioned over a septic tank to provide a passageway between the septic tank and grade level. Such attempts have been less than successful in that ceramic chimney flues often have predetermined lengths of a foot or more, and such components are not easily length-adjustable, i.e. cutting a flue component is time-consuming, expensive and requires specialized tools. Chimney flues are also expensive, and such tile or cement components are also heavy and difficult to handle which leads to labor-intensive and expensive installation.

Another known prior art attempt at creating a crude riser was advertised for sale by American Manufacturing Company, Inc., Manassas, Va., in an October 1989 catalog. That construction was specifically aimed at providing a riser for use with septic system distribution boxes. The so-called "riser" was actually another distribution box unit in which, after first cutting out its bottom, that modified narrow bottom was simply fitted into an opening formed in the wider top of the actual distribution box, so as to create a make-shift riser having a height of about 14 inches. In effect, the user had to cut out the bottom and top of an expensive distribution box to form a riser. Such a construction had many shortcomings including the time-consuming installation process of cutting the top and bottom out of the distribution box to form a riser. For example, distribution boxes are relatively expensive components, and also, their rather flimsy thin-walled construction is unsuitable for holding up under the high weight-bearing loads normally applied to a riser structure at grade level, e.g. garden tractors and even pick-up trucks. The American Manufacturing-type distribution box riser also has a predetermined height of about 14 inches, which excessive height is impractical to adjust from a standpoint of difficulty in cutting the device, plus the fact that a cut edge in a drop box does not readily accept a preformed lid or grade level access cover. A significant shortcoming of this particular prior art riser construction is that the American Manufacturing distribution box has angled side walls, which walls inefficiently distribute the weight placed on the top riser to the bottom distribution box, often resulting in breakage. This weight-bearing load capacity factor is an important consideration when it is considered that, at best, people and 1000 pound riding mowers will pass over the grade level access lid and, at worst, heavier vehicles such as pickup trucks may drive over the lid.

An important aspect of the present invention therefore lies in providing a unique stackable riser formed of light-weight plastic which is usable to form a height-adjustable grade level access for underground components and which forms a rigid structure capable of supporting heavy loads applied to the grade level access lid. A suitable cover means such as an imperforate cover is used to seal the uppermost stackable riser in the vertical riser tower. The injection-molded plastic stackable risers are lightweight and easy to handle. A plurality of such risers can be used to easily, simply and efficiently form a vertical passageway and grade level access (or below grade or other level access, as desired) above an underground drainage or waste system component.

In brief, the stackable riser of this invention includes a cylindrical side wall having outer and inner surfaces and having a first free edge portion and a second edge portion. The side wall of the riser extends in a substantially perpendicular direction with respect to a horizontal plane. The first free edge portion defines a first end opening, and the second edge portion is provided with a U-shaped connecting member which forms an oppositely-facing second end opening. The U-shaped connecting member includes a transverse intermediate portion and first and second generally perpendicular dependent legs which define a channel which is shaped to receive a first free edge portion of another riser. The riser is stackable with other risers to form a riser combination in which the first free edge portions of the risers are interconnected with the U-shaped connecting members of the adjacent risers.

The inner and outer surfaces of the side wall are preferably provided with vertically-extending ribs for strengthening the side wall. However, the inner ribs further include terminal edges which form shoulders positioned a predetermined distance away from the tip of the first free edge portion of the side wall. These shoulders form a ledge for receiving the first dependent leg of the U-shaped connecting member of an adjacent riser so that the first dependent legs and inner ribs of a riser stack all extend along a common vertical axis for efficiently transmitting weight-bearing loads through the entire riser stack. Each of the risers is also preferably provided with a horizontally-extending rib for reinforcing the riser unit's side wall. The horizontally-extending rib preferably extends outward from the intermediate portion of the U-shaped connecting member.

In a rectangular or square riser, the peripheral side wall of the riser includes four sidewall sections which form a generally square or rectangular-shaped riser having four internal corners on the inner surface of the side wall. Each of the corners is provided with a vertically-extending attachment member which includes a shoulder positioned to receive a screw for facilitating attachment of cover means to the riser.

In the preferred embodiment of the present invention, the peripheral side wall of the riser includes a single cylindrical side wall, forming a generally round or circular-shaped riser. Instead of providing vertically-extending attachment members in each corner, the circular riser is provided with pairs of vertical attachment ribs located at 3, 6, 9, and 12 o'clock on the outside of the cylindrical sidewall, i.e. at 90° intervals. Each of the pairs of vertical attachment ribs is adapted to receive a screw therebetween for facilitating attachment of cover means to the circular riser. Because it is recognized that fewer than four attachment screws are sufficient for securing cover means to smaller diameter circular risers, and more than four attachment screws may be desired for securing cover means to large diameter circular risers, fewer or more pairs of vertical attachment ribs may be provided on the outside of the cylindrical sidewall as appropriate in each case. For example, three pairs of attachment ribs may be located at 120° intervals, i.e. at 4, 8 and 12 o'clock, to receive screws extending through corresponding screw bosses in a small diameter imperforate cover for a circular riser. In order to allow for selective vertical height adjustment between the underground component and grade level, the side wall of each riser preferably has a vertical height of approximately 3 to 7.5 inches, and preferably about 6 inches, so that no cutting of the risers is required.

Advantageously, the stackable riser of the present invention preferably has an inner diameter of 20⅛ inches, measured from the innermost edge of the vertically-extending inner ribs. This conforms to recent ASTM standards, requiring a minimum 20-inch opening on any in-ground concrete septic tank.

When a plurality of stackable risers of this invention are stacked together, the side walls of each riser are stacked directly on top of each other and extend along a first common vertical axis for efficiently transmitting weight-bearing loads through the vertical stack. In addition, the first dependent leg of the U-shaped attachment member and the inner ribs also extend along a second common vertical axis for efficiently transmitting loads through the stack. Even when a series of risers are stacked, the inner diameter of the resulting column is still the same as the inner diameter of each individual riser, i.e. 20⅛ inches, and thus still complies with the ASTM standard requiring the diameter to be at least 20 inches. Conventional sealants, such as Silicon caulk, can be applied to the area of the U-shaped attachment member to ensure a liquid-tight, gas-tight seal between adjacent risers such that the column of stacked risers acts as a single riser.

The stackable riser of this invention is usable in combination with underground components such as septic tanks, distribution boxes, or drop boxes. In the combination of the stackable riser and a distribution box, the distribution box includes a tapered cylindrical side wall, a transverse peripheral shoulder extending from a top of the side walls, and a vertically-extending flange. The flange is shaped to be received within the channel formed by the U-shaped connecting member of the risers. When the risers are connected to the distribution box, the side wall of the first riser is positioned directly above the flange of the distribution box. In use, the transverse shoulder of the distribution box extends outward over backfill so that weight-bearing loads which act upon the vertical stack of risers is transmitted directly through the side walls of the risers and the flange of the distribution box to the backfill, thereby transferring the load away from the tapered side wall of the distribution box which might otherwise undesirably result in breakage.

Cover means are provided for attachment to the uppermost riser of the riser stack and covering the vertical passageway formed by same. The cover means may take the form of an imperforate cover or a drain grate, which might be desirable in some applications. The imperforate cover of this invention includes a peripheral gasket-receiving U-shaped attachment portion which includes a transverse intermediate portion and first and second depending legs which define a channel shaped to receive the top free edge of a riser. A dome-shaped cover plate portion connects to the transverse intermediate portion of the U-shaped attachment portion.

The imperforate cover is preferably provided with a centrally located circular rib on an inner surface of the dome-shaped plate portion and a plurality of radially-spaced ribs extend between the circular rib portion and the first depending leg of the U-shaped connection portion. Such an arrangement of ribs effectively forms a strong weight-bearing cover which efficiently transfers any weight-bearing loads through the side walls of the risers in the vertical stack and directly to the septic tank, distribution box or other underground component.

The imperforate cover may further be provided with a gasket in the gasket-receiving U-shaped attachment portion, such as an annular foamed-in polyurethane gasket, to form an air-tight, water-tight, gas-tight seal between the uppermost riser and the cover. It is recognized that when such a gasketed imperforate cover is used in combination with a column of stackable risers having sealant applied to the area of the U-shaped attachment member of each riser and the bottommost riser sealed to a septic tank, the result is an air-tight, liquid-tight, gas-tight septic tank/riser/lid system.

Other features, objects and advantages of the invention will become apparent from the following drawings and description.

DESCRIPTION OF PREFERRED EMBODIMENTS

Figure 1:
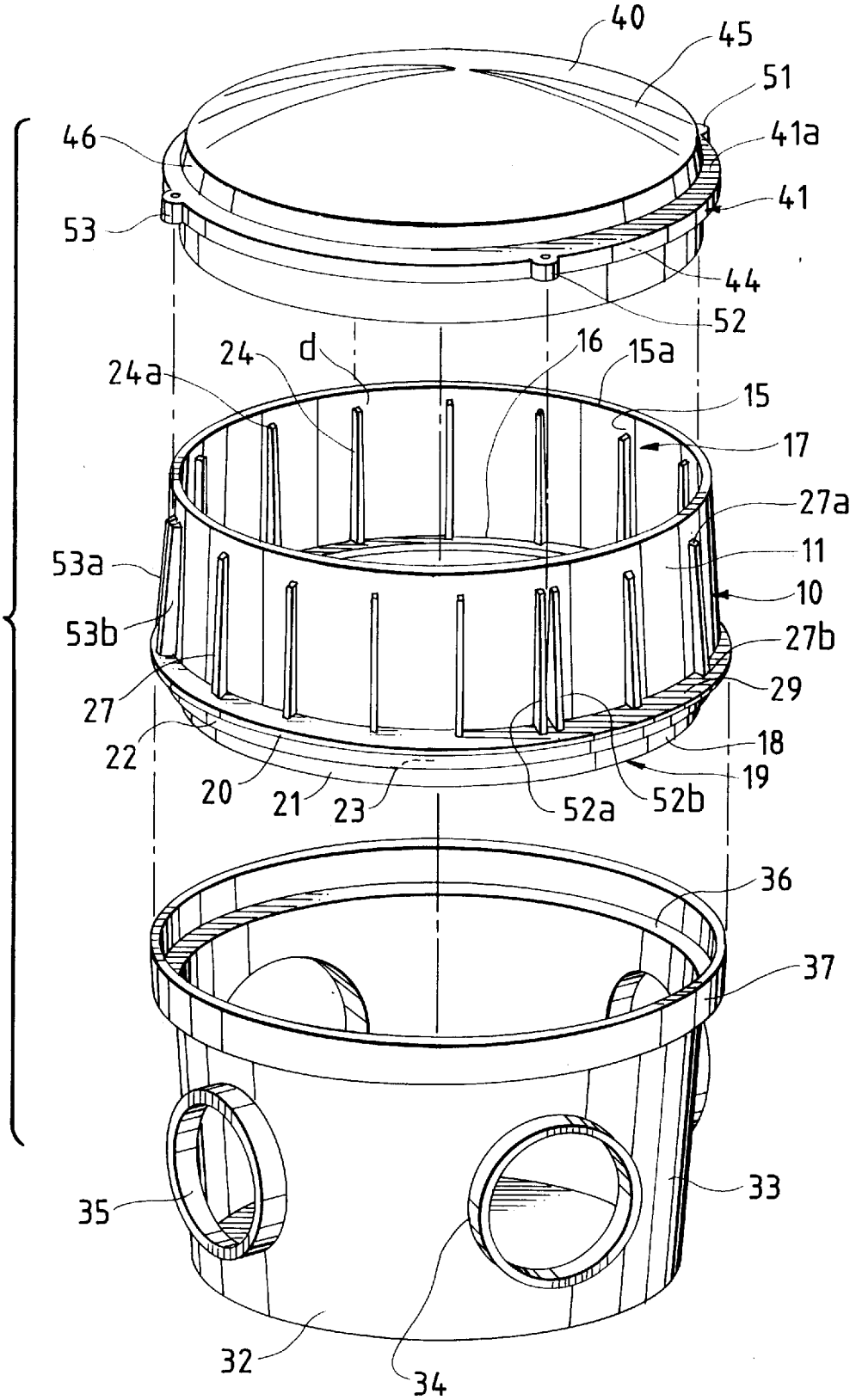
FIG. 1 is a perspective view of the stackable riser embodying this invention, in combination with an imperforate cover and a distribution box.
Figure 2:
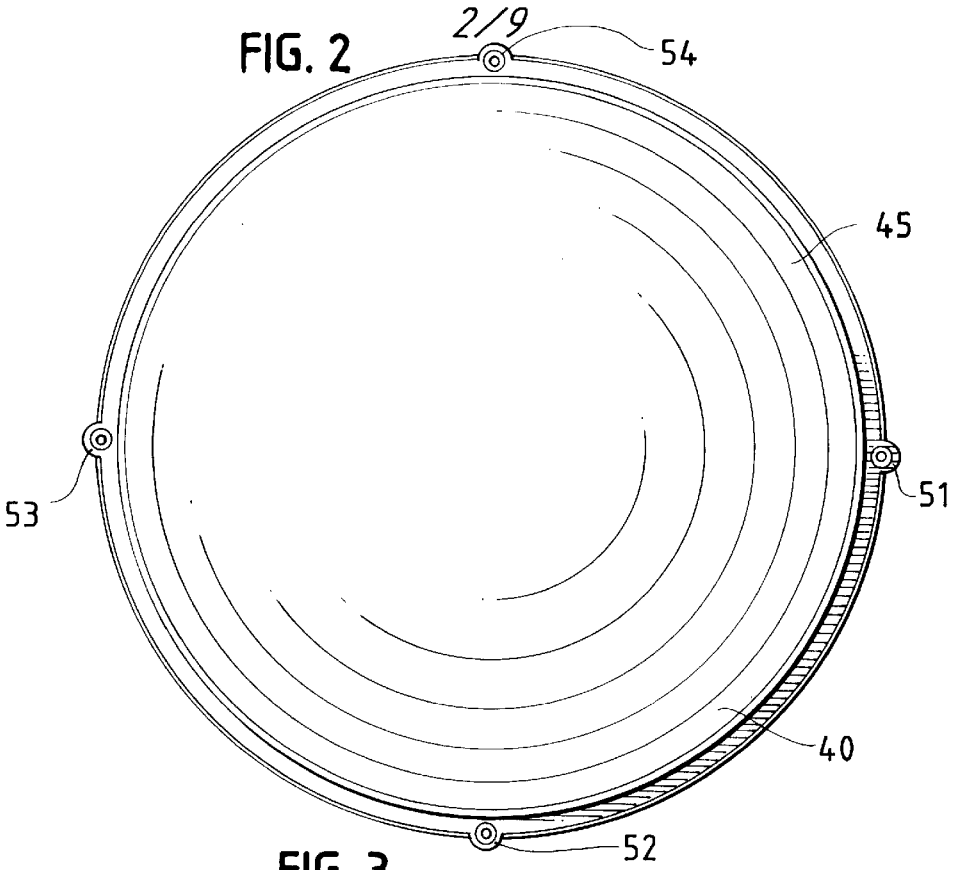
FIG. 2 is a top view of an imperforate cover which is attachable to the stackable riser of this invention.
Figure 3:
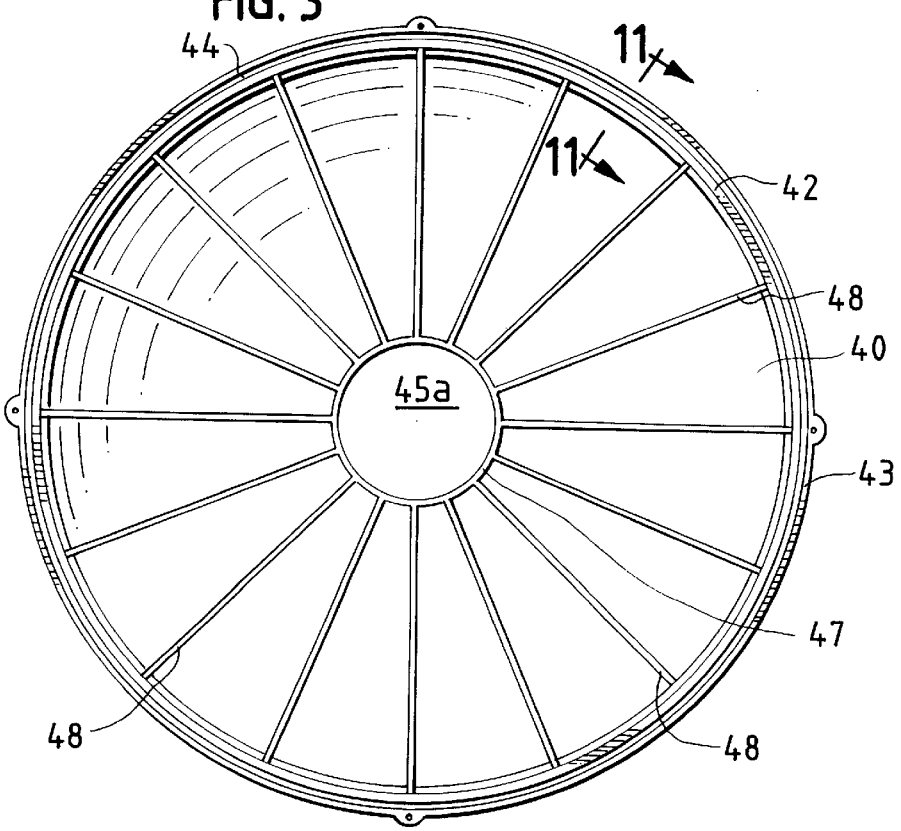
FIG. 3 is a bottom plan view of an imperforate cover which is attachable to the stackable riser of this invention.
Figure 4:
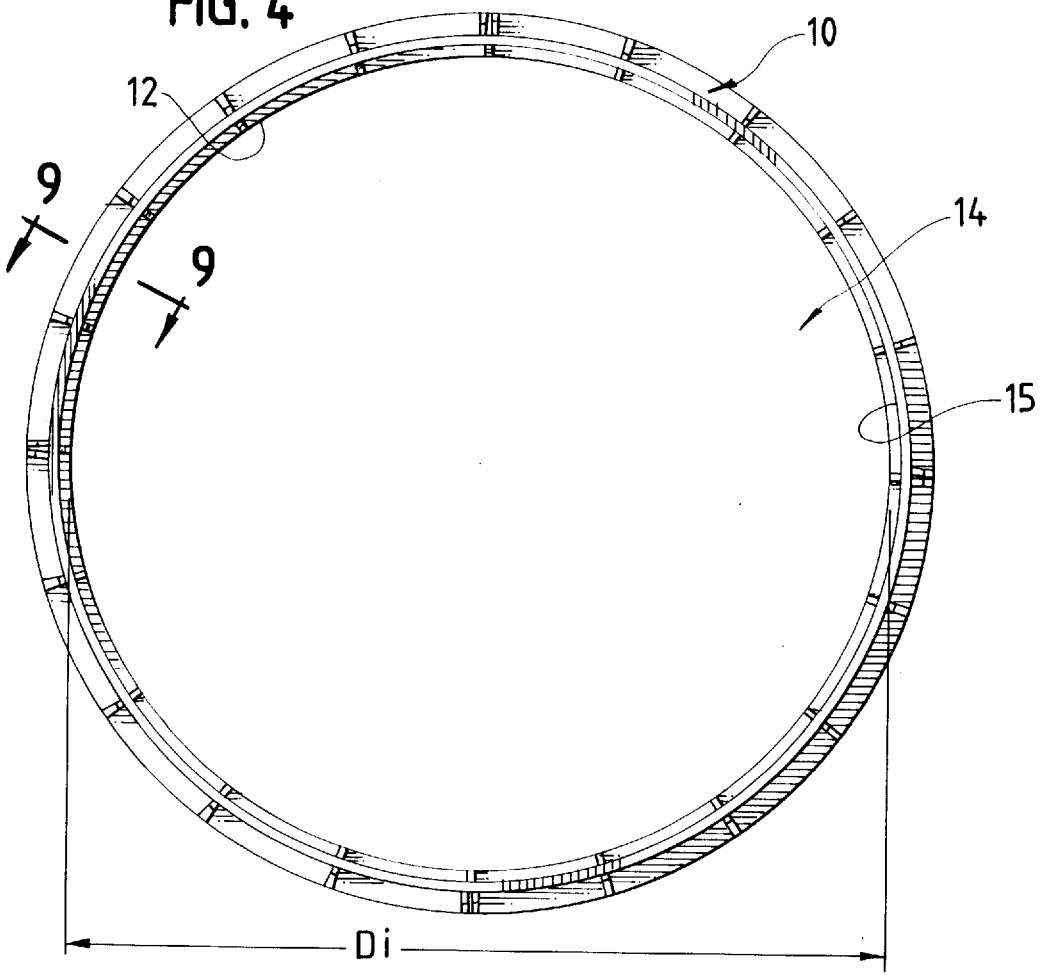
FIG. 4 is a top plan view of the stackable riser of this invention.
Figure 5:
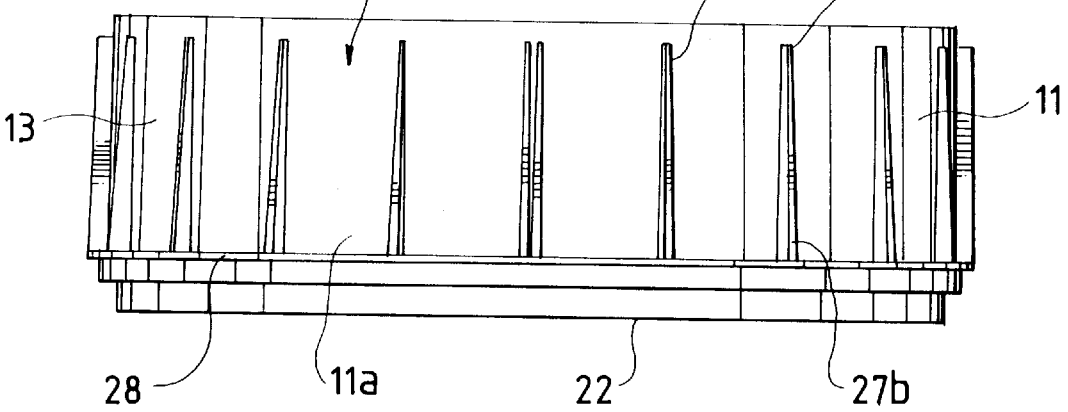
FIG. 5 is a view of the stackable riser of this invention.

Referring to the drawings, the numeral 10 generally designates the stackable riser of this invention which includes a continuous peripheral side wall 11 having inner and outer surfaces 12 and 13, respectively. In the given illustrations, side wall 11 includes cylindrical sidewall section 11*a* which defines a passageway 14 having a generally cylindrical shape. However, it will be understood that peripheral side wall 11 may form differently shaped passageways, such as rectangular, triangular or square depending upon the particular application of the riser.

Side wall 11 includes a first free edge portion 15 and a second edge portion 16, the first free edge portion 15 defining a first end opening 17. A generally inverted U-shaped connecting member 18 extends from bottom edge portion 16 of side wall 11 and defines an oppositely-facing second end opening 19. Generally U-shaped connecting member 18 includes a transverse intermediate portion 20 and first and second dependent legs 21 and 22, respectively. Connecting member 18 defines a channel 23 which is shaped to receive the free edge portion 15 of side wall 11 of another riser. As shown in FIG. 1, first dependent leg 21 has a smaller perimeter than side wall 11 and dependent leg 22 has a greater perimeter than side wall 11 so that channel 23 is positioned directly below side wall 11.

Figure 9:
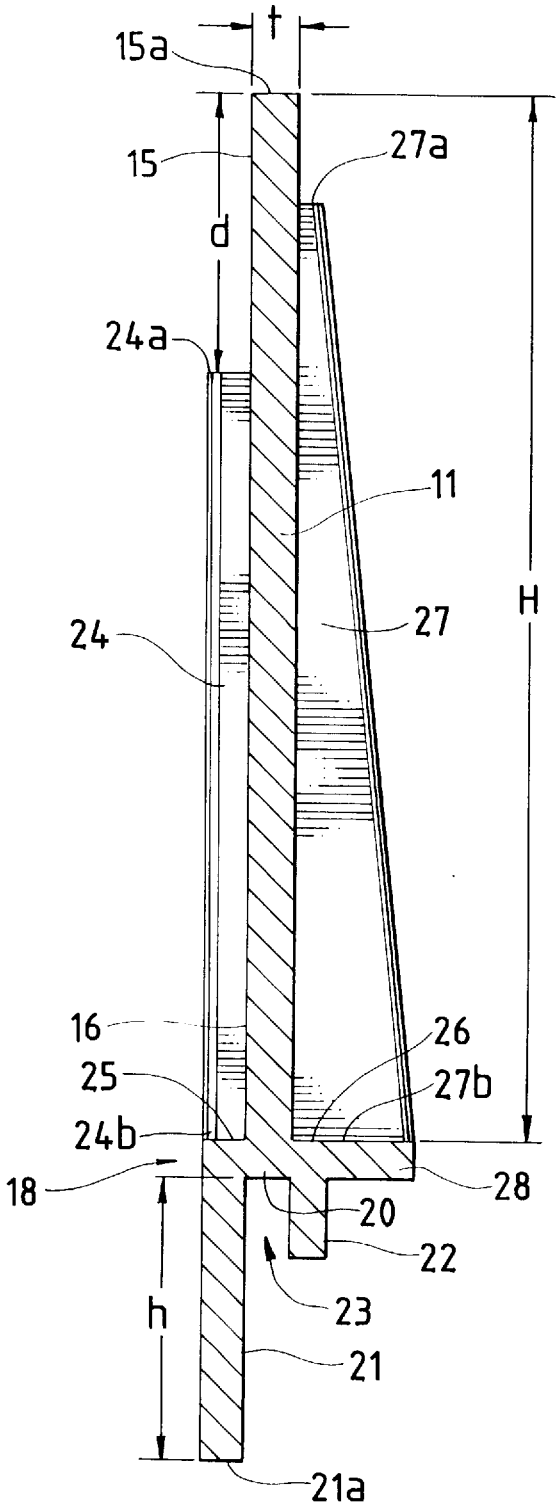
FIG. 9 is a cross-sectional view taken along line 9—9 of FIG. 4.

The inner surface 12 of side wall 11 is preferably provided with a plurality of vertically-extending inner ribs 24. Inner ribs 24 include terminal ends which form shoulders 24*a* spaced a predetermined distance d away from a tip 15*a* of edge portion 15. Predetermined distance d has approximately the same length as a vertical height h of dependent leg 21 so that, when a plurality of risers are stacked together, the distal edge 21*a* of leg 21 rests upon shoulders 24*a* of ribs 24. See FIG. 9. Transverse intermediate portion 20 includes inner and outer shoulders 25 and 26, respectively, and the opposite edges 24*b* of ribs 24 are positioned on the inner shoulder 25 of transverse portion 20. In order to ensure a liquid-tight, gas-tight seal between adjacent risers, conventional sealants such as Silicon caulk may be applied to the area of the U-shaped attachment member of each riser. The sealed risers act together as a single, leak-proof riser.

The dependent legs 21 and 22 of the U-shaped attachment member contributes to the liquid-tight seal by serving as a water stop around the distal edge 15 of an adjacent riser. In order for water or some other liquid to enter or exit the passageway defined by several stacked risers, the liquid would have to first travel a circuitous route around the dependent legs of one riser and the distal edge of the other riser.

A plurality of vertically-extending outer ribs 27 are preferably provided on outer surface 13 of cylindrical side wall 11 to strengthen the side wall. In the given illustrations, outer ribs 27 include terminal ends 27*a* which terminate a predetermined distance from the tip 15*a* of edge portion 15 and opposite edges 27*b* which rests on the outer shoulder 26 of transverse portion 20 of connecting member 18.

A horizontally-extending rib 28 is also preferably provided around the perimeter of side wall 11 to provide rigidity to wall sections 11*a*–11*d* and to maintain the peripheral shape formed by the side wall. In the given illustrations, horizontal rib 28 extends transversely outward from the intermediate portion 20 of connecting member 18. However, it will be understood that the horizontal rib may be provided on other portions of the side wall for reinforcement. Advantageously, horizontal rib 28 includes a ledge 29 which facilitates installation by providing a gripping portion and, also, when the device is installed in underground applications, the backfill will rest upon ledge 29 to hold the riser in position, i.e. provide lateral stability. The backfill also tends to exert downward forces on the ledge 29 in such underground applications, which tends to push adjacent risers together.

One or more of risers 10 are useful to form, in ready snap together fashion, a generally circular vertical tower or passageway between a grade level access and an underground component such as a septic tank or distribution box. Since providing a riser which requires any type of cutting is considered impractical, inconvenient, and labor-intensive, side wall 11 of riser 10 preferably has a vertical height H of approximately 2 to 7.5 inches, and preferably about 7¼ inches. The cylindrical sidewall 11 has an inner diameter $D_i$ of about 8 to 22 inches, preferably in a range between 20 and 22 inches, so as to comply with recent ASTM standards requiring a minimum opening of 20 inches for in-ground concrete septic tanks and so as to form a sufficient opening for an adult to access an underground component and perform any required maintenance therein. The inner diameter $D_i$ is measured from the innermost edge of the vertically extending inner ribs 24. In one exemplary construction, the cylindrical sidewall 11 has an inner diameter $D_i$ of about 20⅛ inches and side wall 11 has a vertical height of about 6 inches. However, as mentioned, it will be understood that other desired shapes, i.e. besides circular, may be formed by side wall 11. Side wall 11 preferably has a thickness t of approximately 0.15 to 0.2 inches.

Stackable riser 11 is preferably formed from high density polyethylene and may be injection molded in a conventional manner. It will also be understood that other lightweight rigid polymeric materials such as polypropylene and PVC may be suitable. Forming stackable riser 11 of such a lightweight plastic is highly advantageous as the construction is lightweight, easy to handle and install, and of non-corrosive material.

Figure 7:
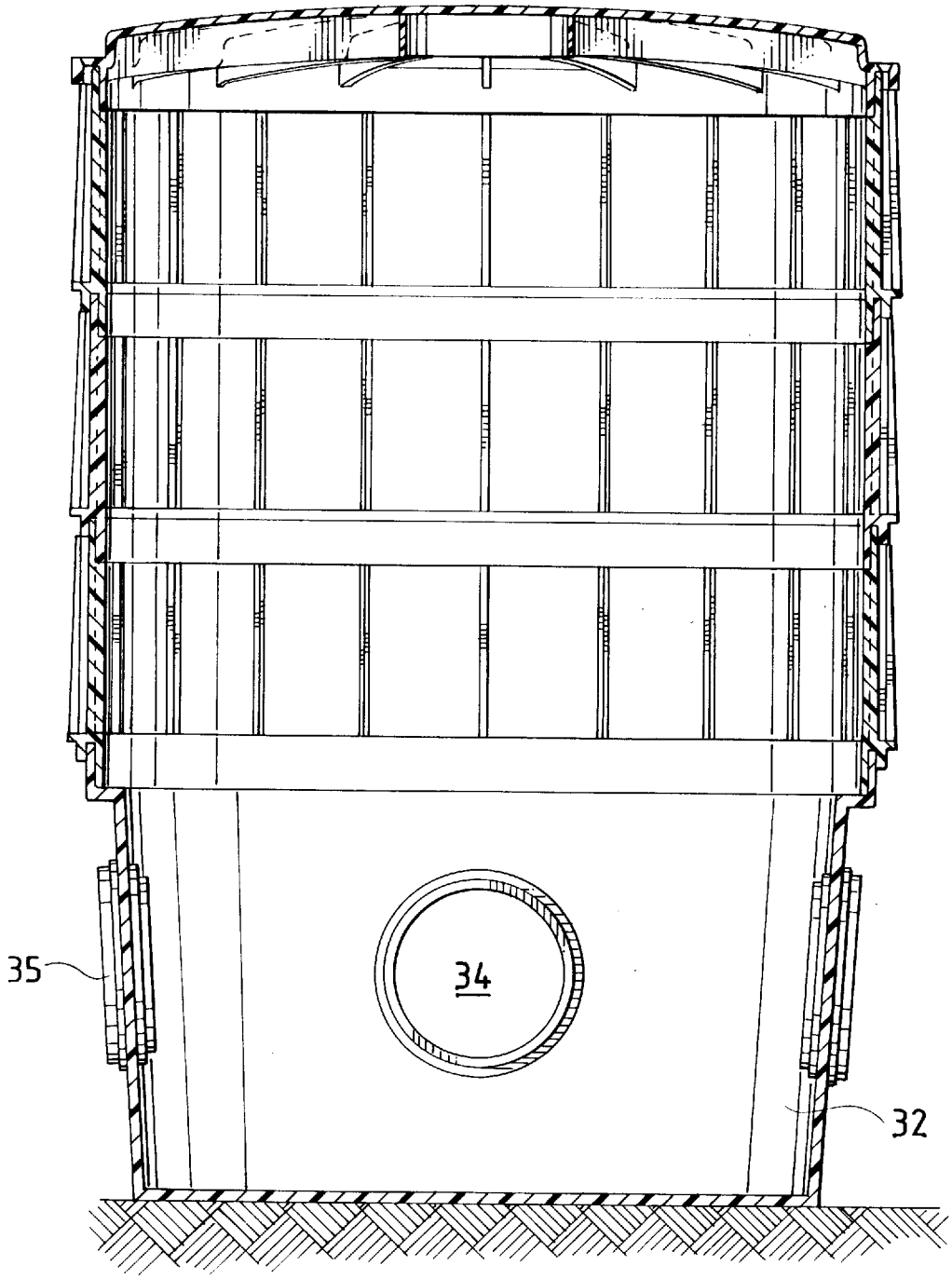
FIG. 7 is a cross-sectional view illustrating a plurality of stackable risers of this invention in combination with an imperforate cover and a distribution box.

FIG. 1 illustrates the combination of a cylindrical riser and a round distribution box 32. In this specification the term distribution box is used to also cover drop boxes which are a specific subclass of the more generic term "distribution box". A particularly advantageous drop box is disclosed in co-owned U.S. Pat. No. 4,663,036, which is hereby incorporated by reference. FIG. 7 illustrates, in cross-section, the combination of a plurality of stacked circular risers shown in combination with the distribution box 32. Distribution box 32 includes a tapered cylindrical side wall 33 which defines apertures 34 for receiving sealing members 35 and lengths of pipe (not shown). A peripheral transverse shoulder 36 extends from the top of side walls 33 and generally extends in a horizontal or transverse direction. An upright or vertically-extending flange 37 extends from shoulder 36 and is shaped to be received within the channel 23 of connecting member 18 of riser 10.

When positioned underground, shoulder 36 of distribution box 32 rests upon the backfill and, hence, any weight-bearing loads applied to the top of the vertical tower 38 of cover means and riser 10 will be transmitted directly through vertical axes V1 and V2 to shoulder 36 and the backfill. Thus, any such weight-bearing loads are not significantly applied to the angled side wall 33 of distribution box which might otherwise cause breakage.

Figure 10:
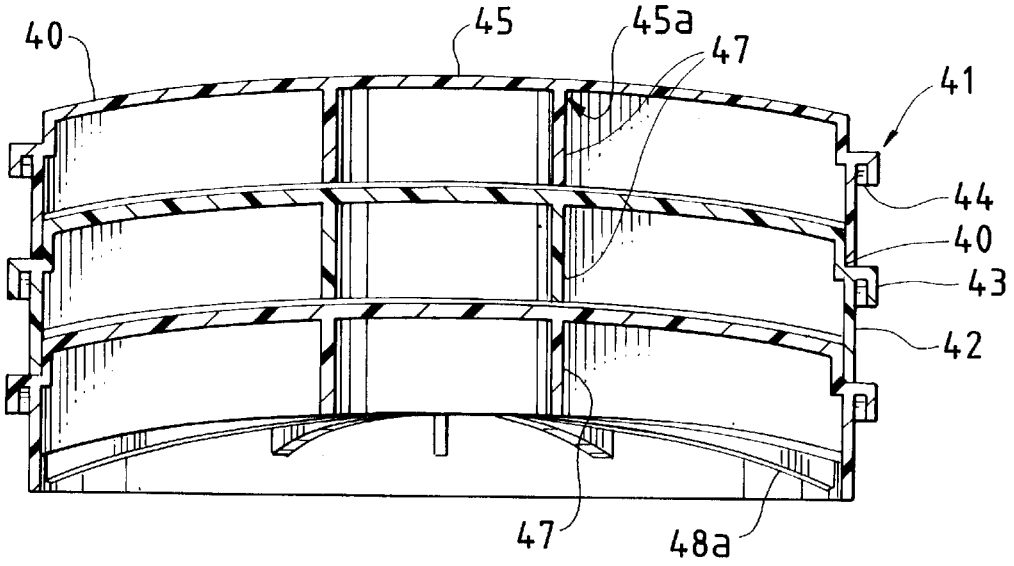
FIG. 10 is a side cross-sectional view of a plurality of imperforate covers of this invention.
Figure 11A:
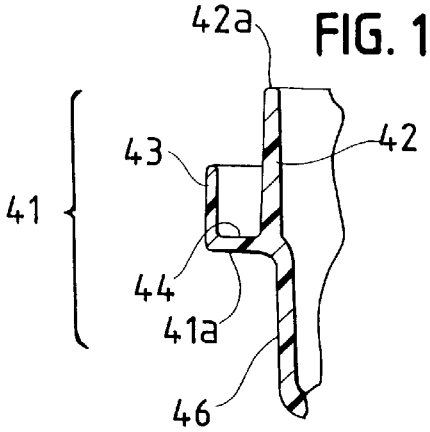
FIG. 11*a* is a cross-sectional view of the imperforate cover taken along line 11—11 of FIG. 3.
Figure 11B:
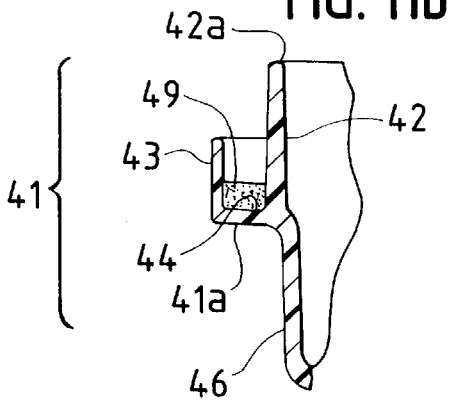
FIG. 11*b* is a cross-sectional view of the imperforate cover taken along line 11—11 of FIG. 3 showing an annular gasket in the channel of the cover.

Removable cover means are provided for attaching to and sealing the open end 17 defined by the free edge portion 15 of the uppermost riser in the vertical stack 38 as desired. The cover means may advantageously take the form of an imperforate lid or cover 40 which is illustrated in FIGS. 1, 2, 3, 7 and 8. As most clearly seen in FIG. 1, cover 40 includes a peripheral attaching portion 41 which includes an intermediate transverse portion 41*a,* and first and second depending legs 42 and 43. First depending leg 42, which is the inner-most depending leg, is preferably longer than second depending leg 43. Attachment portion 41 defines a channel 44 between depending legs 42 and 43 which is shaped to receive the free end portion 15 of side wall 11 of riser 10. See FIGS. 10, 11*a,* and 11*b.* To distinguish the channel 23, the transverse intermediate portion 20, and first and second dependent legs 21 and 22 of the stackable cylindrical risers, these components of the cover 40 may also be referred to as cover attaching channel 44, first and second cover attaching depending legs 42 and 43, and cover attaching transverse intermediate portion 41*a.* Advantageously, attaching portion 41 may have the same, or a similar, construction as the connecting member 18 of riser 10. Thus, first cover attaching depending leg 42 may have a vertical height approximately equal to predetermined distance d between the terminal ends 24*a* and the tip 15*a* of edge portion 15 of the stackable risers. This allows the distal edge 42*a* of leg 42 to rest upon shoulders 24*a* of ribs 24 of the uppermost riser in the same manner as the stackable risers. Cover 40 further includes a dome-shaped plate portion 45 which connects to the intermediate portion 41*a.* The dome-shaped plate portion 45 preferably includes stacking surfaces 46 which extend generally vertically upward from the intermediate portion 41*a* of attachment portion 41 and which are shaped to be received within the depending leg 42 of the attachment portion 41 of another imperforate cover 40. This enables a plurality of such covers to be easily stackable for storage or transport as illustrated in FIG. 10.

In order to ensure a water-tight gas-tight seal between the imperforate cover 40 and the uppermost riser 11, the cover is preferably provided with an annular foamed-in gasket 49 in the cover attaching channel 44. The annular gasket 49 may take the form of a polyurethane foam gasket. It is recognized that the gasket may be added to the channel 44 as a separate operation during manufacture of the cover 40. The cover 40 is preferably formed from the same high density polyethylene as the stackable riser 11 and may be formed by conventional injection molding techniques. Other suitable polymeric materials may be used for the cover 40, such as polypropylene or PVC. It is further recognized that when the imperforate cover 40 having the annular gasket 49 is used in combination with a column of stackable risers 11 having sealant such as Silicon caulk applied to the area of the U-shaped attachment member 18 of each riser, and the bottom most riser sealed to a septic tank, a liquid-tight, gas-tight septic tank/riser system is achieved. Annular polyurethane foam-type gaskets may likewise be used in the U-shaped attachment member 18 of the risers, i.e. in the channel 23 of each riser, in order to further ensure an adequate seal between adjacent risers, however use of such gaskets are generally unnecessary in the risers because conventional sealants are adequate and, in most applications, the risers generally do not have to be separated and re-attached, whereas it is a desirable feature for the cover 40 to be removable.

Cover 40 preferably includes a circular rib 47 which extends generally downward from an inner central portion 45*a* of plate portion 45. A plurality of radially-spaced, downwardly-extending reinforcing ribs 48 are provided which extend between circular rib 47 and depending leg 42 of cover 40. This particular arrangement of a central circular rib 40 and radially-spaced ribs 48 is particularly advantageous for providing a weight-bearing cover for the risers of this invention and for distributing weight-bearing loads along the first and second vertical axes V1 and V2. Preferably, radially-spaced ribs 48 include curved surfaces 48*a* which are shaped to conform to the dome-shaped plate portion 45 of an adjacent cover 40 when the lids are stacked together as illustrated in FIG. 10.

In order to secure cover 40 to the uppermost riser 10, cover 40 includes screw bosses 51, 52, 53, 54 disposed on the attachment portion 41 at 3, 6, 9, and 12 o'clock, respectively, i.e. at 90° intervals. Corresponding pairs of vertically-extending outer ribs 51*a*–51*b,* 52*a*–52*b,* 53*a*—53*b,* 54*a*–54*b* provided on outer surface 13 of cylindrical side wall 11 are spaced so as to receive a fastener member, such as a screw, therebetween. The spacing may be, for example, 1/10 inch for 1.5/10 inch screws. The terminal end 27*a* on each of the outer ribs 51*a,* 51*b,* 52*a,* 52*b,* 53*a,* 53*b,* 54*a,* 54*b* terminate a sufficient distance from the tip 15*a* of the edge portion 15 of the circular riser to provide space for dependent leg 21 of another stackable cylindrical riser or depending leg 43 of the attaching portion 41 of cover 40. Advantageously, the pairs of vertically extending outer ribs can withstand multiple uses, so the cover 40 may be removed as often as necessary to gain access to the passage way defined by the stackable risers, and once the cover is replaced, fastener members may be reinserted between the outer ribs to re-secure the cover to the uppermost riser. It is recognized that fewer than four attachment screws may be sufficient for securing cover 40 to smaller diameter risers, while more than four screws may be desired for large diameter circular risers, so different arrangements of the pairs of vertical attachment ribs, i.e. fewer or more pairs, may be constructed as appropriate.

Figure 6:
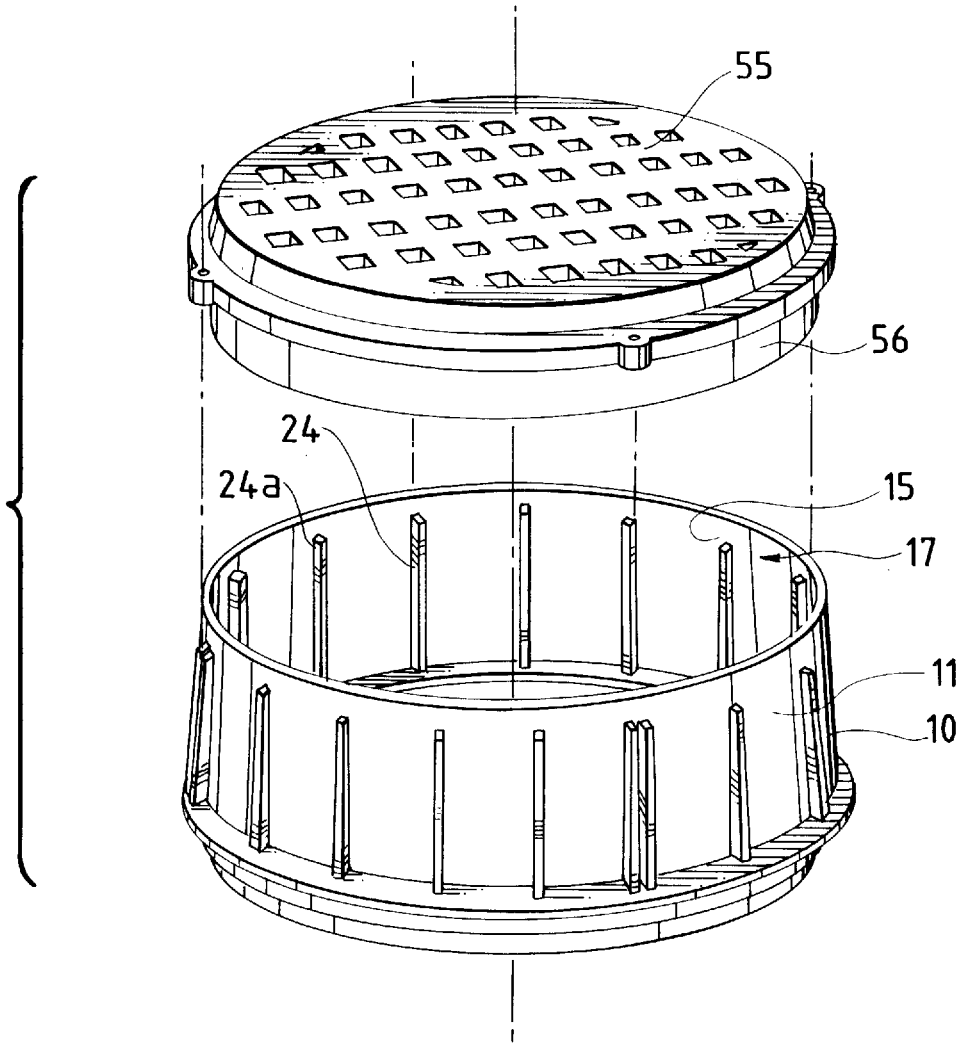
FIG. 6 is a perspective view of the stackable riser of this invention and a drain grate.

In an alternate construction, the cover means may take the form of a circular drain grate 55 as illustrated in FIG. 6. Drain grate 55 includes a circumferential side wall 56 which is shaped to be received within the first end opening 17, which is defined by the upper edge portion 15 of side wall 11 of riser 10. When assembled together, circumferential side wall 56 preferably rests upon shoulders 24*a* of inner ribs 24. Such drain grates may be used with the riser of this invention in particular applications such as forming, field drains, or the like.

Figure 8:
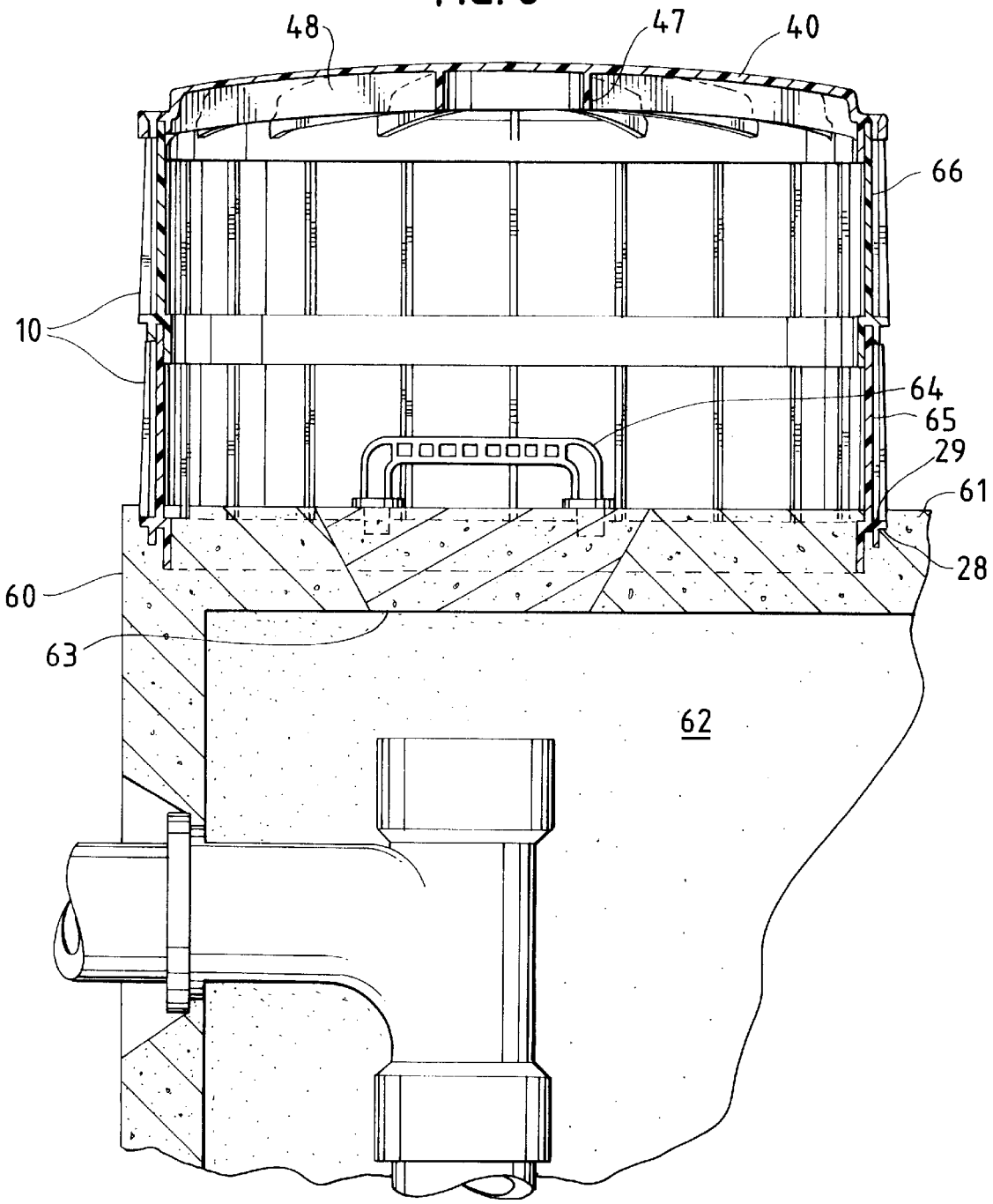
FIG. 8 is a cross-sectional view of a plurality of stackable risers of this invention in combination with an imperforate cover and a septic tank.
Figure 8A:
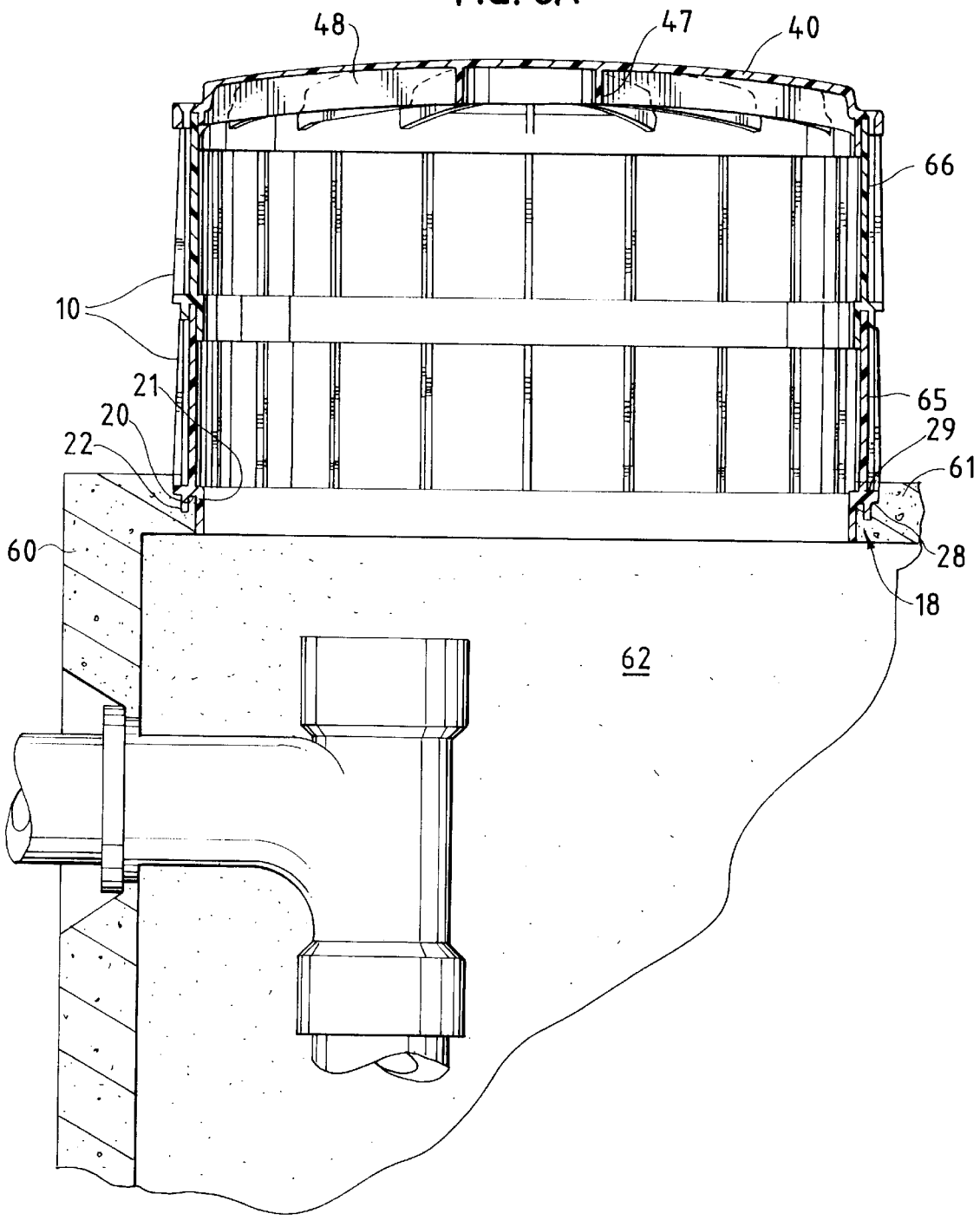
FIG. 8A is a cross-sectional view of an alternate arrangement of a plurality of stackable risers of this invention in combination with an imperforate cover and a septic tank.

The combination of a plurality of stackable risers 10 of this invention and a septic tank 60 is illustrated in FIGS. 8 and 8A. Septic tank 60 includes a concrete or cement top 61 having an access means for allowing access to the interior 62 of septic tank 60. In the illustration given in FIG. 8, the access means takes the form of a concrete lid 63 which is connected to a plastic handle 64. A particularly advantageous plastic handle for embedding in concrete components is commercially available from the assignee of the present invention, namely Tuf-Tite, Inc. of Wauconda, Ill., under its part number H1, for example. In the illustration given in FIG. 8A, the access means is an opening coinciding with the opening at the bottom end of the lowermost riser 10, such that the passage way formed by the stacked risers provides direct access to the interior of the septic tank.

Advantageously, when the lowermost riser is cast in cement or concrete over a septic tank as shown in FIGS. 8 and 8A, the transverse intermediate portion 20 and the dependent legs 21 and 22 of the U-shaped connecting member 18 of the lowermost riser cooperate with the concrete to prevent any lateral or vertical movement of the passageway.

A vertical column of risers 10 includes a first riser, 65, and securement means are provided for attaching first riser 65 over the access means of septic tank 60. In the illustration given in FIG. 8, the securement means takes the form of the concrete or cement top 61 of the septic tank in which the connecting member 18 of riser 65 is embedded. Most advantageously, the horizontal rib 28 of riser 66 is also embedded in the concrete of septic tank top 61 so that the concrete acts on ledge 29 to firmly secure the riser 65 to the septic tank. The vertical stack of risers also includes an uppermost riser, which in some constructions may also be the first riser, but is illustrated in FIG. 8 as riser 66. Riser 66 is connected to riser 65 as previously discussed and also includes an imperforate cover 40 as also previously discussed.

While in the foregoing embodiments of the invention have been disclosed in considerable detail for purposes of illustration, it will be understood by those skilled in the art that many of these details may be varied without departing from the spirit and scope of the invention.

I claim:

1. A stackable riser comprising:

a cylindrical side wall having outer and inner surfaces and having a first free edge portion which defines a first end opening and having a second edge portion; and a generally inverted U-shaped connecting member extending from said second edge portion of said side wall and defining an oppositely-facing second end opening, said U-shaped connecting member including a transverse intermediate portion and first and second generally perpendicular dependent legs which define a channel between said dependent legs which is shaped to receive a first free edge portion of another riser; and a plurality of terminal ends on said inner surface, intermediate said first end opening and said second edge portion, and each of said terminal ends positioned a predetermined distance away from a tip of said first free edge portion of said cylindrical side wall.

2. The invention of claim 1 in which said first dependent leg of said U-shaped connecting member has a smaller diameter than said cylindrical side wall and has a vertical height which is approximately equal to said predetermined distance between said terminal ends and said tip of said first free edge portion.

3. The invention of claim 1 in which said transverse intermediate portion of said U-shaped connecting member forms inner and outer shoulders and each of said terminal ends being a terminal edge of a vertically-extending inner rib, said vertically-extending ribs including opposite ends positioned on said inner shoulder.

4. The invention of claim 1 in which a plurality of vertically-extending outer ribs are disposed on said outer surface of said side wall.

5. The invention of claim 4 in which at least two pairs of said vertically-extending outer ribs are spaced from one another so as to receive a fastening member therebetween.

6. The invention of claim 1 in which a horizontally-extending rib is connected to said side wall.

7. The invention of claim 6 in which said horizontally-extending rib extends transversely outward from said transverse intermediate portion of said U-shaped connecting member.

8. The invention of claim 6 or 7 in which said horizontally-extending rib includes a ledge.

9. A stackable riser comprising:

a cylindrical side wall having outer and inner surfaces in which said outer surface of said cylindrical side wall is provided with a plurality of terminal ends positioned a predetermined distance away from a first free edge portion of said cylindrical side wall.

10. The invention of claim 9 in which said terminal ends are each a terminal edge of a vertically-extending outer rib, said vertically-extending outer ribs being disposed in pairs around said outer surface at 90° intervals.

11. The invention of claim 9 in which said cylindrical side wall has an inner diameter of approximately 8 to 22 inches.

12. The invention of claim 9 in which said cylindrical side wall has an inner diameter of approximately 20⅛ inches.

13. A stackable riser combination comprising:

a plurality of stackable risers which are interlocked together to form a vertical passageway, each of said risers comprising:

a cylindrical side wall having outer and inner surfaces and having first and second edge portions, said inner surface of said side wall defining a passageway extending between said first and second edge portions; and a U-shaped connecting member extending from said second edge portion of said side wall and including a transverse intermediate portion and first and second generally perpendicular dependent legs which define a channel between said dependent legs which is shaped to receive a first edge portion of another riser;

said plurality of stackable risers including at least first and second risers in which said first edge portion of said first riser is inserted into said U-shaped connecting member of said second riser.

14. The stackable riser combination of claim 13, said risers further including a plurality of vertically-extending inner ribs positioned on said inner surface of said cylindrical side wall, each of said inner ribs including a terminal edge positioned a predetermined distance away from said first edge portion, said first dependent leg of said U-shaped connecting member of said second riser being positioned on said terminal edges of said inner ribs of said first riser.

15. The invention of claim 13 in which a plurality of vertically-extending outer ribs are disposed on said outer surfaces of said cylindrical side wall of each of said plurality of risers.

16. The invention of claim 13 in which a horizontally-extending rib extends transversely outward from said cylindrical side wall of each of said risers.

17. The invention of claim 16 in which said horizontally-extending rib extends transversely outward from said transverse intermediate portion of said U-shaped connecting member of each of said risers.

18. The invention of claim 16 or 17 in which each of said horizontally-extending ribs includes a ledge.

19. The invention of claim 13 in which said outer surface of the cylindrical side wall of each of said risers includes a plurality of pairs of vertically-extending outer ribs, the ribs of each of said pairs being spaced so as to receive a fastener therebetween, each of said ribs including a terminal edge positioned a predetermined distance away from said first edge portion of said cylindrical side wall, and each of said pairs of outer ribs being spaced 90° from one another around said cylindrical side wall.

20. The invention of claim 19 in which said cylindrical side wall has an inner diameter of approximately 8 to 22 inches.

21. The invention of claim 19 in which said cylindrical side wall has an inner diameter of approximately 20⅛ inches.

22. The invention of claim 13 in which said cylindrical side walls of all of said plurality of said risers are vertically aligned.

23. The invention of claim 13 in which said inner ribs and said first dependent leg of each of said plurality of said risers are vertically aligned.

24. The stackable riser combination of claim 13 further comprising:

a tank located below the lowermost of said plurality stackable risers, said tank having a top including access means therein and said second edge portion of said lowermost riser secured to said top with the passageway of said riser positioned over said access means.

25. The stackable riser of claim 24, further comprising a removable cover located over the upper most of said plurality of stackable risers, said cover including a peripheral attaching portion including first and second cover attaching depending legs and a cover attaching transverse intermediate portion therebetween which define a cover attaching channel between said cover attaching depending legs which is shaped to receive the first edge portion of said uppermost riser.

26. The stackable riser of claim 1, wherein said side wall extends substantially perpendicularly with respect to a horizontal plane.

27. The stackable riser of claim 10, each of said pairs of vertically-extending outer ribs adapted to receive a fastening element therebetween.

28. The invention of claim 14 in which said transverse intermediate portion of said U-shaped connecting member of each of said risers forms inner and outer shoulders and said vertically-extending inner ribs include opposite edges positioned on said inner shoulders.

29. The stackable riser combination of claim 25 wherein said removable cover further includes an annular gasket seated in said cover attaching channel for providing a substantially gas-tight, and substantially liquid-tight seal between said uppermost riser and said cover.

30. The stackable riser combination of claim 24, wherein said tank is a septic tank.

31. A stackable riser comprising:

a cylindrical side wall having outer and inner surfaces and having a first free edge portion which defines a first end opening and having a second edge portion; and a generally inverted U-shaped connecting member extending from said second edge portion of said side wall and defining an oppositely-facing second end opening, said U-shaped connecting member including a transverse intermediate portion and first and second generally perpendicular dependent legs which define a channel between said dependent legs which is shaped to receive a first free edge portion of another riser; and means provided on said inner surface for supporting a second edge portion of another riser.

32. The stackable riser of claim 26, wherein said means for supporting a second edge portion of another riser comprises at least one rib on said inner surface, intermediate said first end opening and said second edge portion.

* * * * *

UNITED STATES PATENT AND TRADEMARK OFFICE

CERTIFICATE OF CORRECTION

PATENT NO. : 5,852,901

DATED : Dec. 29, 1998

INVENTOR(S) : Theodore W. Meyers

It is certified that error appears in the above-indentified patent and that said Letters Patent is hereby corrected as shown below:

On the Title Page, under:

References Cited

U.S. PATENT DOCUMENTS add:

-- 3,772,826 11/1973 Ferver ..... 52/137
4,472,911 9/1984 Jooris et al. ..... 52/20
4,663,036 5/1987 Stoble, Jr. et al. ..... 210/170
4,998,387 3/1991 Geiger ..... 52/20
5,046,886 9/1991 Muir et al. ..... 52/137

FOREIGN PATENT DOCUMENTS 1964319 12/1969 Germany ..... 52/19
2185053 7/1987 United Kingdom ..... 52/20

OTHER PUBLICATIONS

American Manufacturing Company, Inc., "American On-Site Products" catalog, Oct. 1989. --

Signed and Sealed this

Tenth Day of April, 2001

*Attest:*

Nicholas P. Godici

NICHOLAS P. GODICI

*Attesting Officer*

*Acting Director of the United States Patent and Trademark Office*